US007922247B2

(12) United States Patent
Dickie

(10) Patent No.: US 7,922,247 B2
(45) Date of Patent: Apr. 12, 2011

(54) HYDRAULIC ADJUSTABLE SEAT

(75) Inventor: Robert G. Dickie, King City (CA)

(73) Assignee: Spark Innovations, Inc., King City, Ontario (CA)

( * ) Notice: Subject to any disclaimer, the term of this patent is extended or adjusted under 35 U.S.C. 154(b) by 222 days.

(21) Appl. No.: 12/148,425

(22) Filed: Apr. 18, 2008

(65) Prior Publication Data

US 2009/0261641 A1 Oct. 22, 2009

(51) Int. Cl.
*A61G 15/00* (2006.01)

(52) U.S. Cl. ..... 297/314; 297/264.1; 297/344.14; 297/344.19

(58) Field of Classification Search ..... 297/264.1, 297/DIG. 3, 302.3, 302.2, 308, 314, 344.14–344.24, 297/451.1, 311, 325, 463.1; 108/6, 7; 248/371, 248/162.1, 157
See application file for complete search history.

(56) References Cited

U.S. PATENT DOCUMENTS

| | | | | | |
|---|---|---|---|---|---|
| 1,427,480 | A | * | 8/1922 | Konigsberg | 248/371 |
| 2,132,291 | A | * | 10/1938 | Fitos | 248/583 |
| 2,284,352 | A | * | 5/1942 | Zank | 248/565 |
| 2,615,499 | A | * | 10/1952 | De Loss | 297/325 |
| 3,315,934 | A | * | 4/1967 | Ora | 248/550 |
| 3,784,148 | A | * | 1/1974 | Hill | 248/582 |
| 3,902,755 | A | * | 9/1975 | Sirot | 297/339 |
| 4,095,770 | A | * | 6/1978 | Long | 248/371 |
| 4,131,260 | A | * | 12/1978 | Ambasz | 248/599 |
| 4,636,001 | A | * | 1/1987 | Weyenberg | 297/314 |
| 5,435,625 | A | | 7/1995 | Weber | |
| 5,572,933 | A | * | 11/1996 | Thompson | 108/7 |
| 5,577,803 | A | * | 11/1996 | Guilbaud | 297/314 |
| 5,590,930 | A | * | 1/1997 | Glockl | 297/313 |
| 5,743,591 | A | | 4/1998 | Tame | |
| 5,871,257 | A | * | 2/1999 | Dundes, Sr. | 297/314 |
| 6,053,574 | A | | 4/2000 | Opsvik | |
| 6,199,952 | B1 | | 3/2001 | Davis | |
| 6,206,335 | B1 | * | 3/2001 | Huber et al. | 248/601 |
| 6,227,563 | B1 | | 5/2001 | Talisman | |
| 6,398,303 | B1 | * | 6/2002 | Herrmann et al. | 297/314 |
| 6,481,795 | B1 | | 11/2002 | Pettibon | |
| 6,863,017 | B2 | * | 3/2005 | Charles et al. | 114/363 |
| 7,063,386 | B2 | * | 6/2006 | Dowty et al. | 297/338 |
| 7,131,911 | B2 | * | 11/2006 | Kim | 473/279 |
| 7,229,133 | B2 | | 6/2007 | Maddelein et al. | |

FOREIGN PATENT DOCUMENTS

| | | |
|---|---|---|
| GB | 1027240 | 4/1988 |
| JP | 2006068223 | 3/2006 |

* cited by examiner

*Primary Examiner* — Laurie K Cranmer
(74) *Attorney, Agent, or Firm* — Sand & Sebolt

(57) ABSTRACT

An adjustable chair and a tilt assembly for use therewith typically provides side to side tilting of the chair seat and preferably provides forward and backward tilting of the seat separately or in combination with the side to side tilting. A hydraulic system is provided for controlling the tilting movement. Progressive hydraulic valves are used to control the resistance to the tilting movement whereby the chair is useful for exercise while the user is seated and the rate at which the tilting occurs may be controlled. The seat may be locked in any tilted position or the user may shift weight on the seat to provide a continuous shifting of the tilt angle and tilt direction of the seat.

17 Claims, 13 Drawing Sheets

HYDRAULIC ADJUSTABLE SEAT

BACKGROUND OF THE INVENTION

1. Technical Field

The present invention relates generally to adjustable chairs. More particularly, the present invention relates to a tilt assembly which allows the user of the chair to tilt the seat in any direction. Specifically, the present invention relates to such a tilt assembly which utilizes hydraulic systems to provide a selected resistance to the tilting movement as well as to provide a hydraulic lock for securing the seat at a chosen tilted position.

2. Background Information

While adjustable chairs have been known for some time, ergonomically adjustable seating which is widely available to the public at large is a more recent development which may be due to the use of computers, which has substantially increased the number of office workers who are desk bound. Most of the currently available adjustable chairs are adjusted at a first sitting or early on in the use of the chair such that the chair typically remains in the position set by the user of the chair. While the ability of the user to adjust the chair may be helpful in providing comfort to the user, this fixed position is still generally less than desirable due to the amount of time that the user spends in the chair. Thus, this stationary or sedentary work position is less than desirable in terms of productivity, employee morale, and the minimization of sick days taken by employees. Most of the currently available ergonomic chairs provide for the height adjustment of the seat, (usually by a gas lift strut or mechanical rotary screw), the forward and backward tilting of the seat, and the forward and backward tilting of the backrest. However, to the Applicant's knowledge, current ergonomic chairs do not provide for the side to side tilting of the chair seat nor do they provide a chair seat which may be set for continuous tilting movement in any direction while providing a control for the degree of resistance to the tilting movement, which is useful for controlling the speed at which the tilting movement occurs as well as a mechanism for exercise while the user is seated. The present invention addresses these and other problems in the art.

BRIEF SUMMARY OF THE INVENTION

The present invention includes an apparatus comprising: a base and a seat support which has a front, a back, and opposed sides, is adapted to mount on the bottom of a seat, and is disposed above and pivotally mounted on the base whereby the seat support is tiltable from side to side relative to the base.

The present invention also includes an apparatus comprising: a base; a seat support which is adapted to mount on the bottom of a seat, and is disposed above and pivotally mounted on the base whereby the seat support is tiltable relative to the base; and a hydraulic system for controlling tilting movement of the seat support relative to the base.

DETAILED DESCRIPTION OF THE INVENTION

Figure 1:
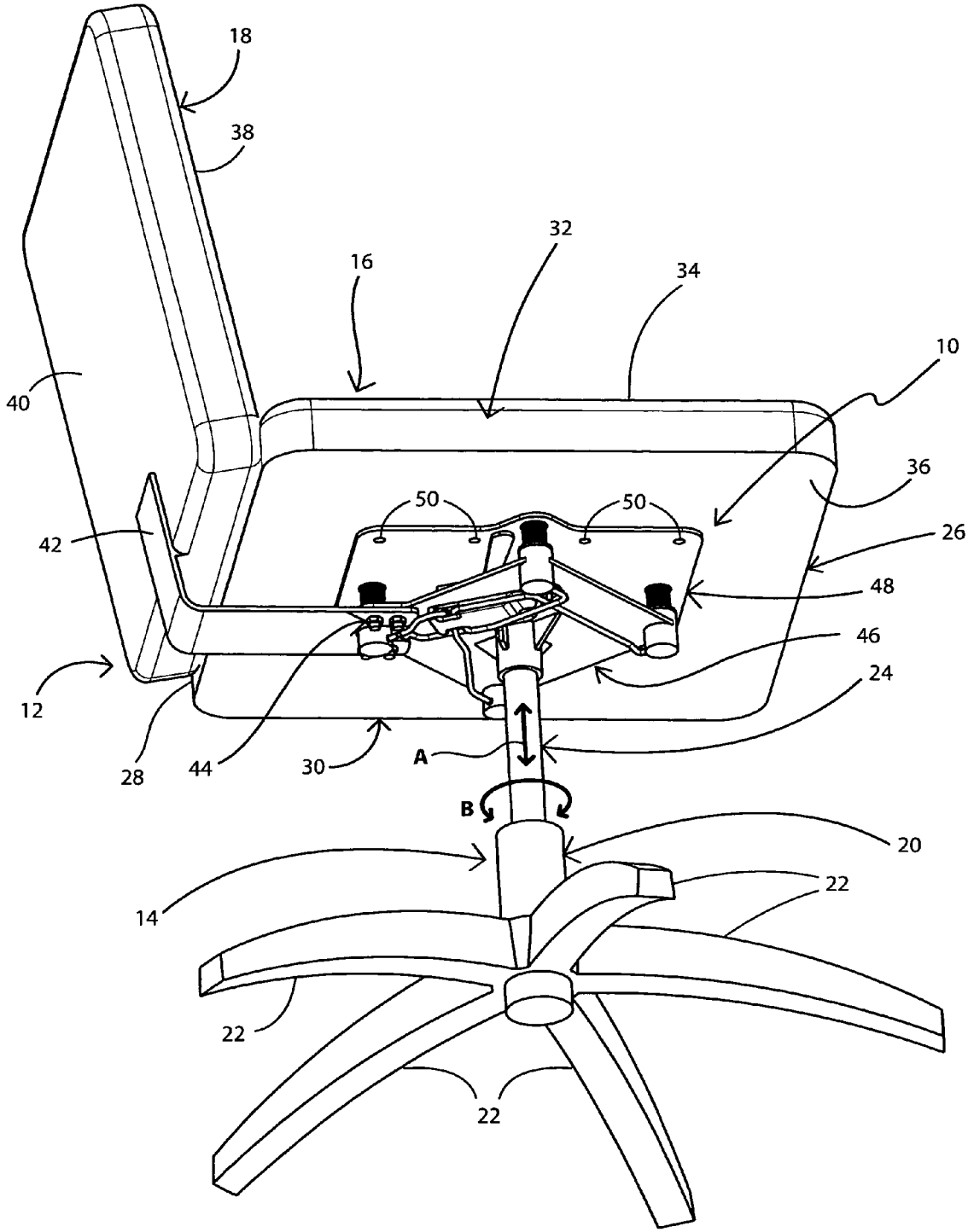
FIG. 1 is a perspective view generally from the bottom of a chair utilizing the tilt assembly of the present invention.

The tilt assembly of the present invention is indicated generally at 10 in FIG. 1 in use with an adjustable chair 12 which includes a chair base 14, a seat 16 and a backrest 18. Tilt assembly 10 is configured to allow seat 16 to tilt relative to base 14 and backrest 18 in the forward and backward direction as well as in the side to side direction. Although assembly 10 may be used with a variety of chairs, chair 12 in the exemplary embodiment is shown as an office chair which may have various adjustment features other than those provided by tilt assembly 10. In the exemplary embodiment, chair base 14 includes a generally vertical support post 20 which is secured to and extends upwardly from a set of five legs 22 which project radially outwardly from the lower end of post 20 and are adapted to contact a support surface such as the ground or the floor. Legs 22 may include wheels mounted thereon although not shown in the present embodiment. Support post 20 may be a rigid non-adjustable post, but preferably includes a height adjustment mechanism 24 which typically involves the use of a gas spring. Seat 16 is a generally flat structure which is typically oriented horizontally in its home position. Seat 16 has a front 26, a rear 28, left and right sides 30 and 32, a top 34 and a bottom 36. Top 34 typically is formed of a cushion material on which a person may sit while bottom 36 is typically formed of a rigid material to which tilt assembly 10 is secured. Backrest 18 has a front 38 typically formed of a cushion material for resting a person's back against and a rear 40 which is typically made of a substantially rigid material. Backrest 18 extends upwardly and generally vertically from adjacent rear 28 of seat 16 and is secured to assembly 10 via an L-shaped connector 42 which has an upwardly extending leg secured adjacent the lower end of rear 40 of backrest 18 and a forward extending leg which is secured adjacent its front terminal end to assembly 10 via four nut and bolt fasteners 44. Height adjustment mechanism 24 provides for vertical adjustment as indicated at arrow A in FIG. 1. In addition, seat 16 and backrest 18 may be rotated or swiveled about the vertical axis passing through support 20 typically 360 degrees, as indicated at arrow B in FIG. 1.

Tilt assembly 10 includes a base 46 which is mounted on the top of support post 20 and on which backrest 18 is mounted via connector 42 at fasteners 44. Assembly 10 further includes a seat support 48 which is secured to bottom 36 of seat 16 via a plurality of fasteners 50 typically in the forms of screws. Seat support 48 is configured to tilt relative to base 46 forward and backward and from side to side, and most preferably in any direction. Tilt assembly 10 further includes a tilt control which in part controls the direction in which seat 16 and seat support 48 may tilt relative to base 46. The tilt control also controls the degree of resistance to the tilting movement and thus the amount of force which must be applied to tilt seat support 48 in a given direction, this force being provided in the exemplary embodiment solely by the shifting of the user's weight on seat 16.

Figure 2:
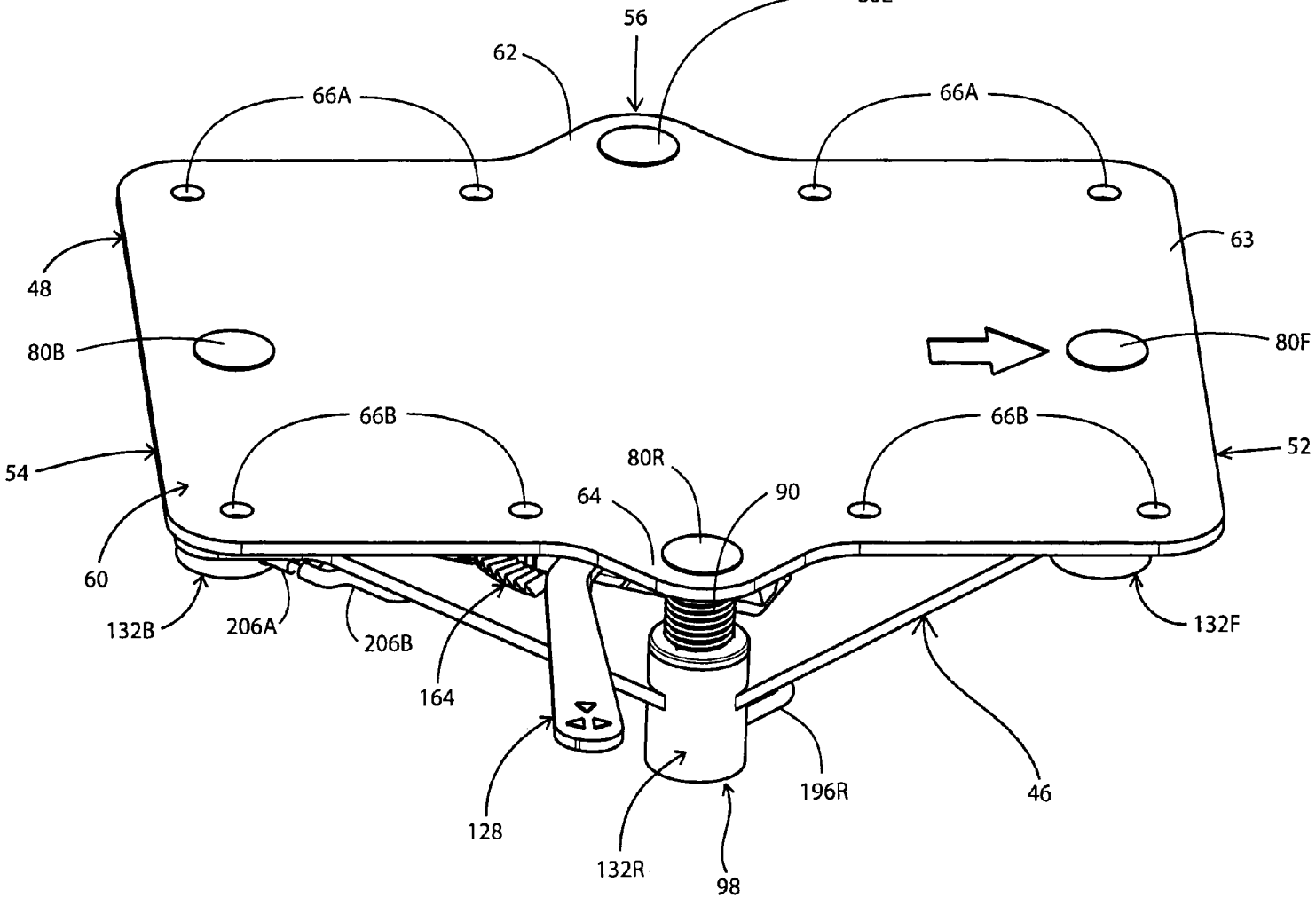
FIG. 2 is a perspective view generally from the top showing the tilt assembly removed from the chair.
Figure 3:
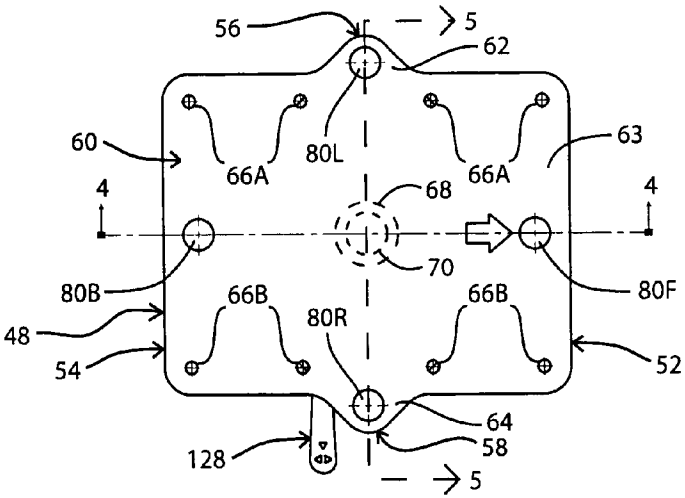
FIG. 3 is a top plan view of the tilt assembly.
Figure 4:
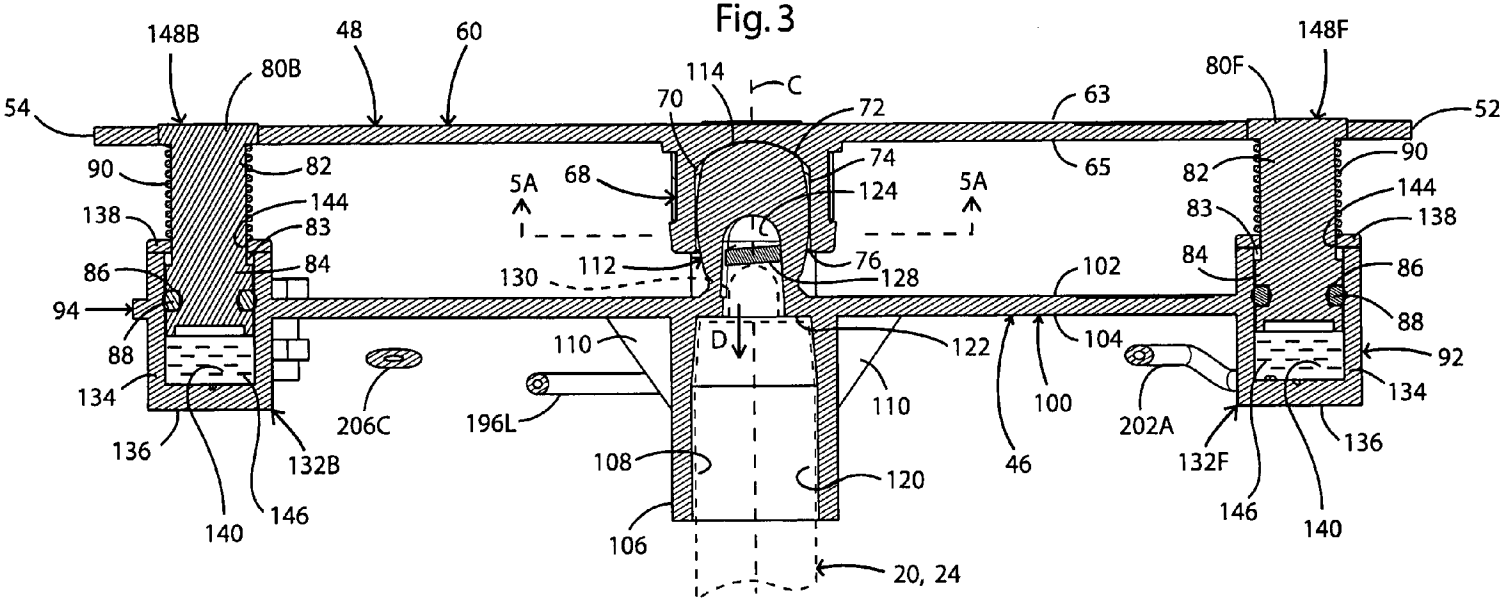
FIG. 4 is an enlarged sectional view taken on line 4-4 of FIG. 3.

Tilt assembly 10 is described in greater detail beginning with seat support 48 and with primary reference to FIGS. 2-4. Seat support 48 has a front 52, a back 54 and left and right sides 56 and 58. Support 48 includes a support plate 60 which is generally rectangular and includes left and right generally triangular flanges 62 and 64 extending outwardly opposite one another from the rectangular shape along left and right sides 56 and 58. Support plate 60 has a top 63 in the form of a flat upwardly facing surface and a parallel bottom 65 in the form of a flat downwardly facing surface. A set of four left mounting holes 66A and a set of four right mounting holes 66B are formed respectively adjacent left and right sides 56 and 58 of plate 60 extending from top 63 to bottom 65. Through holes 66 are configured to receive therethrough fasteners 50 (FIG. 1) for securing plate 60 to seat 16 with top 63 of plate 60 abutting the flat bottom 36 of seat 16. As shown in FIG. 4, seat support 48 further includes a generally cylindrical collar 68 which is rigidly secured to and extends downwardly from bottom 65 of plate 60 and defines a downwardly opening cavity or socket 70. Collar 68 and socket 70 are centrally located midway between front and back 52 and 54 as well as between left and right sides 56 and 58. Collar 68 defines a partial spherical concave surface 72 which bounds the top or upper portion of socket 70. In other words, concave surface 72 lies along a portion of a spherical boundary. Collar 68 further includes a hexagonal inner perimeter 74 which extends downwardly from concave surface 72 to a bottom entrance opening 76 at the bottom of collar 68. The hexagonal configuration of perimeter 74 is best shown in FIG. 5A.

Four pistons are rigidly mounted on plate 60 and extend downwardly therefrom, including a front piston 80F adjacent from 52, a back piston 80B adjacent back 54, a left piston 80L adjacent left side 56 and a right piston 80R adjacent right side 58. Each of pistons 80F and 80B are positioned midway between left and right sides 56 and 58 and are aligned with their respective centers collinear with the center of collar 68 and socket 70, as shown in FIG. 3. Left and right pistons 80L and 80R are mounted on flanges 62 and 64 and also have centers which are aligned collinear with the center of collar 68 and socket 70 along a line which is perpendicular to that along which pistons 80F and 80B are aligned. In the exemplary embodiment, each of pistons 80 is substantially identical and thus positioned equidistant from the center of socket 68 along a common circle concentric about the center of socket 68. In other words, each of pistons 80 is equidistant from a central vertical axis C (FIG. 4) which passes through the center of collar 68 and socket 70. Pistons 80 are thus circumferentially equidistant from one another with respect to axis C and in the exemplary embodiment each adjacent pair of pistons 80 is equidistant from each other so that pistons 80 lie at the corners of a square as viewed from above. Each piston 80 has a neck or shaft 82 which steps radially outwardly at an annular ledge 83 to a head 84 having a diameter greater than shaft 82. An annular groove 86 which is typically circular is formed in head 84 extending inwardly from its outer diameter. An annular flexible seal 88 typically in the form of an O-ring or circular seal formed of an elastomer is disposed in groove 86 and extends outwardly from the outer perimeter of head 84 a short distance. A coil spring 90 is mounted on each piston 80 circumscribing the respective shaft 82 thereof. Spring 90 extends downwardly from seat support 48 to base 46.

Base 46 is now described in greater detail with primary reference to FIGS. 4-7. Base 46 has a front 92, a back 94 and left and right sides 96 and 98 which are respectively aligned with front 52, back 54 and left and right sides 56 and 58 of seat support 48. Base 46 includes a flat and generally square rigid plate 100 which is typically oriented horizontally. Plate 100 has a top 102 in the form of a flat upwardly facing surface which faces bottom 65 of plate 60 and a bottom 104 in the form of a flat downwardly facing surface. A chair base mounting structure is provided for mounting base 46 on the upper end of support post 20 of chair base 14. This mounting structure in the exemplary embodiment includes a mounting cylinder 106 which defines a downwardly opening cavity 108 which is generally cylindrical and may include an upper section which tapers inwardly below plate 100. Cylinder 106 is rigidly connected to and extends downwardly from bottom 104 of plate 100 and is centrally located so that the center of cylinder 106 and cavity 108 are aligned along vertical axis C when base 46 and seat support 48 are mounted on one another. Four braces 110 are rigidly secured to the outer perimeter of cylinder 108 and extend upwardly to a rigid connection with the bottom 104 of plate 100 to provide additional support to cylinder 108. A ball or ball like member 112 is rigidly secured to and extends upwardly from top 102 of plate 100 directly above cavity 108 and is centered about axis C. Ball member 112 is received within socket 70 to provide a ball and socket pivotal connection between base 46 and seat support 48 whereby seat support 48 is tiltable in any direction relative to ball member 112. The cap of ball member 112 defines a partial spherical convex surface 114 having a curvature which mates with the partial spherical concave surface 72 of collar 68. Surface 72 thus is supported by and slides along surface 114 during the tilting movement of support 48 relative to base 46. Ball member 112 further includes a generally barrel shaped section having a hexagonal outer perimeter 116 formed of eight arcuate facets 118. As shown in FIG. 5A, arcuate facets 118 as seen along a horizontal section are straight and mate with respective facets 78 of collar 68 so that facets 78 slide along respective facets 118 during tilting movement of support 48. The non-circular cross-section and mating configuration of outer perimeter 116 and inner perimeter 74 prevents rotational movement of seat support 48 relative to base 46 about axis C. As viewed from the side, arcuate facets 118 form arcs of respective circles which have a diameter greater than that of the spherical surfaces 114 and 72.

As shown in FIG. 4, cavity 108 includes a wider section 120 defined by cylinder 106 which steps radially inwardly at a step 122 to a narrower section 124 which extends from wider section 120 upwardly into ball member 112 about half way from its bottom to its top. A through passage or entrance opening 126 is formed in the sidewall of ball member 112 and extends from its outer perimeter to its inner surface whereby it communicates with narrower section 124 and opens to the side. A terminal end of a control lever 128 is received within the narrower section 124. In addition, the upper end of support post 20 and height adjustment mechanism 24 (dashed lines in FIG. 4) is received within cavity 108 when base 46 is mounted on chair base 14. The gas spring of mechanism 24 includes a depressible activator pin or button 130 at its upper end which may be activated by control lever 128. More particularly, lever 128 may be operated so that its terminal end within narrower section 124 is moved downwardly to move button 130 downwardly (arrow D in FIG. 4) in order to activate the gas spring, that is, to unlock it from a given position and allow the internal pressure to create a lifting motion on tilt assembly 10 and seat 16. This mechanism operates in a standard fashion and thus allows assembly 10 and seat 16 to be raised when the user appropriately operates lever 128 when the user has removed his or her weight from seat 16. Also in standard fashion, the user may operate lever 128 and apply his or her weight downwardly on seat 16 to lower seat 16 and assembly 10.

Figure 5:
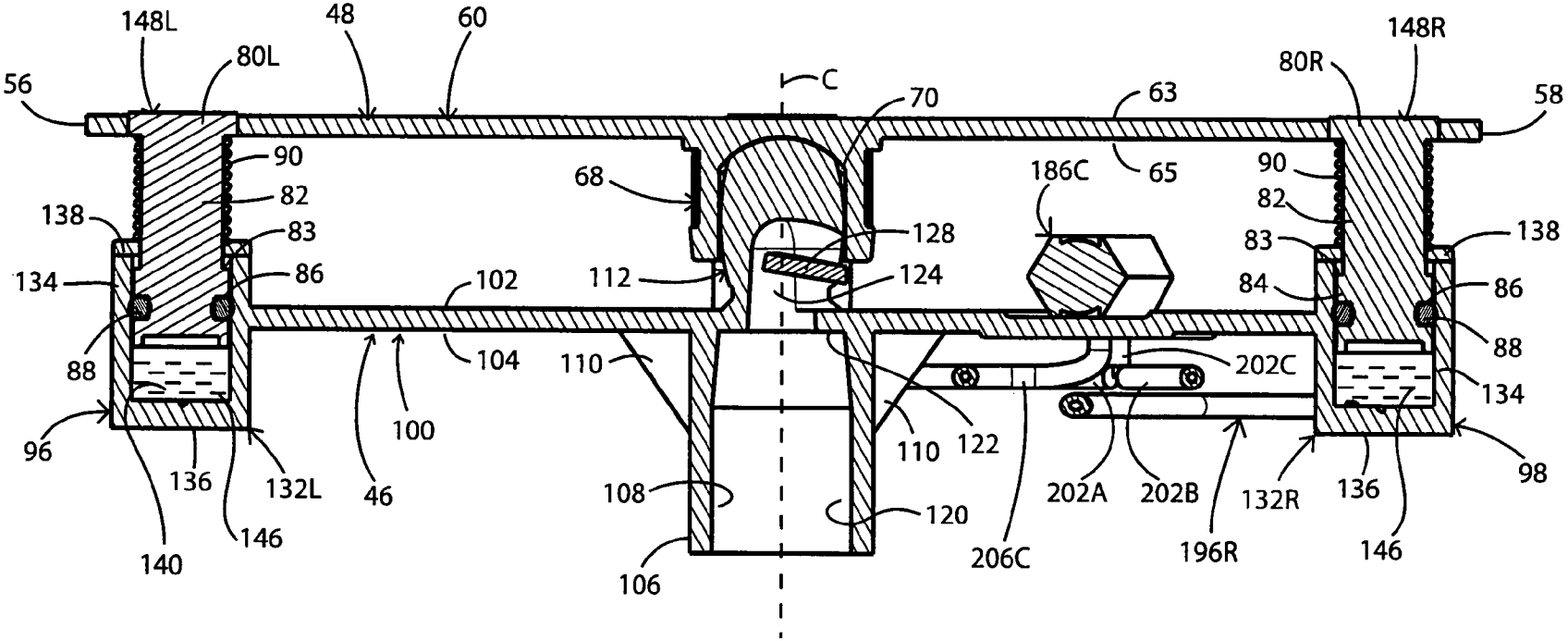
FIG. 5 is an enlarged sectional view taken on line 5-5 of FIG. 3.
Figure 5A:
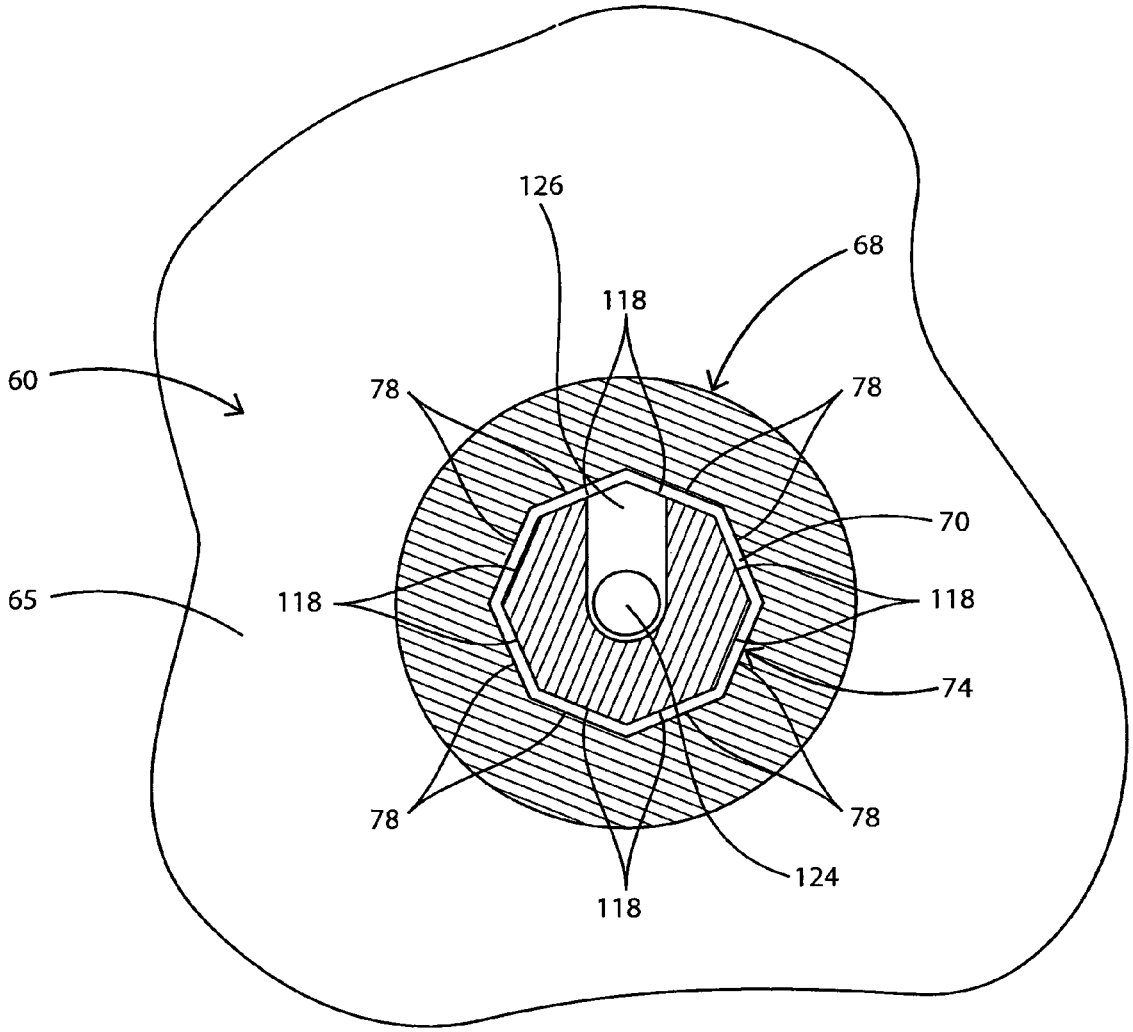
FIG. 5A is a sectional view taken on line 5A-5A of FIG. 4.

With continued reference to FIGS. 4-7, base 46 includes a front cylinder 132F, a back cylinder 132B, and left and right cylinders 132L and 132R each of which is rigidly mounted on plate 100 with a portion extending upwardly from top 102 and a portion extending downwardly opposite therefrom from bottom 104. Each cylinder 132 includes a cylindrical sidewall 134, a circular bottom wall 136 connected to the bottom of sidewall 134 and an annular top wall 138 secured to the top of sidewall 134 whereby walls 134, 136 and 138 define therewithin a cylindrical interior chamber 140. A single or sole entry/exit port 142 is formed through sidewall 134 adjacent bottom wall 136 and communicates with interior chamber 140 below the bottom of the respective piston 80 which is slidably received within interior chamber 140. More particularly, annular top wall 138 defines a circular entrance opening 144 at the top of each cylinder 132 so that shaft 82 is slidably received to move in the up and down direction within entrance opening 144. Head 84 of each piston 80 is in its entirety disposed within interior chamber 140 and slidable therein so that seal 88 slides along the cylindrical inner surface of sidewall 134 along a continuous circular interface therewith. Entrance opening 144 has a smaller diameter than that of interior chamber 140, whereby ledge 83 of head 84 may abut the bottom of annular top wall 138, which serves as a stop to the upward movement of the respective piston 80 and associated portion of seat support 48 during the tilting movement thereof. As shown in FIGS. 4 and 5, hydraulic fluid 146 is disposed within interior chambers 140 and moves through the associated hydraulic lines and valves which are discussed further below. Any suitable hydraulic fluid may be used although fluid 146 is preferably self-lubricating and non-staining. It has been found that mineral oil fulfills these characteristics although other fluids may be used. Pistons 80 and cylinders 132 thus form respective laterally spaced hydraulic actuators 148 in the form of piston cylinder combinations. More particularly, these include a front actuator 148F, and back actuator 148B and left and right actuators 148L and 148R. Front and back actuators 148F and 148B are disposed on opposite sides of the ball and socket pivotal connection respectively forward and rearward thereof while left and right actuators 148L and 148R are likewise disposed on opposite sides of said pivotal connection respectively to the left and right thereof.

Figure 6:
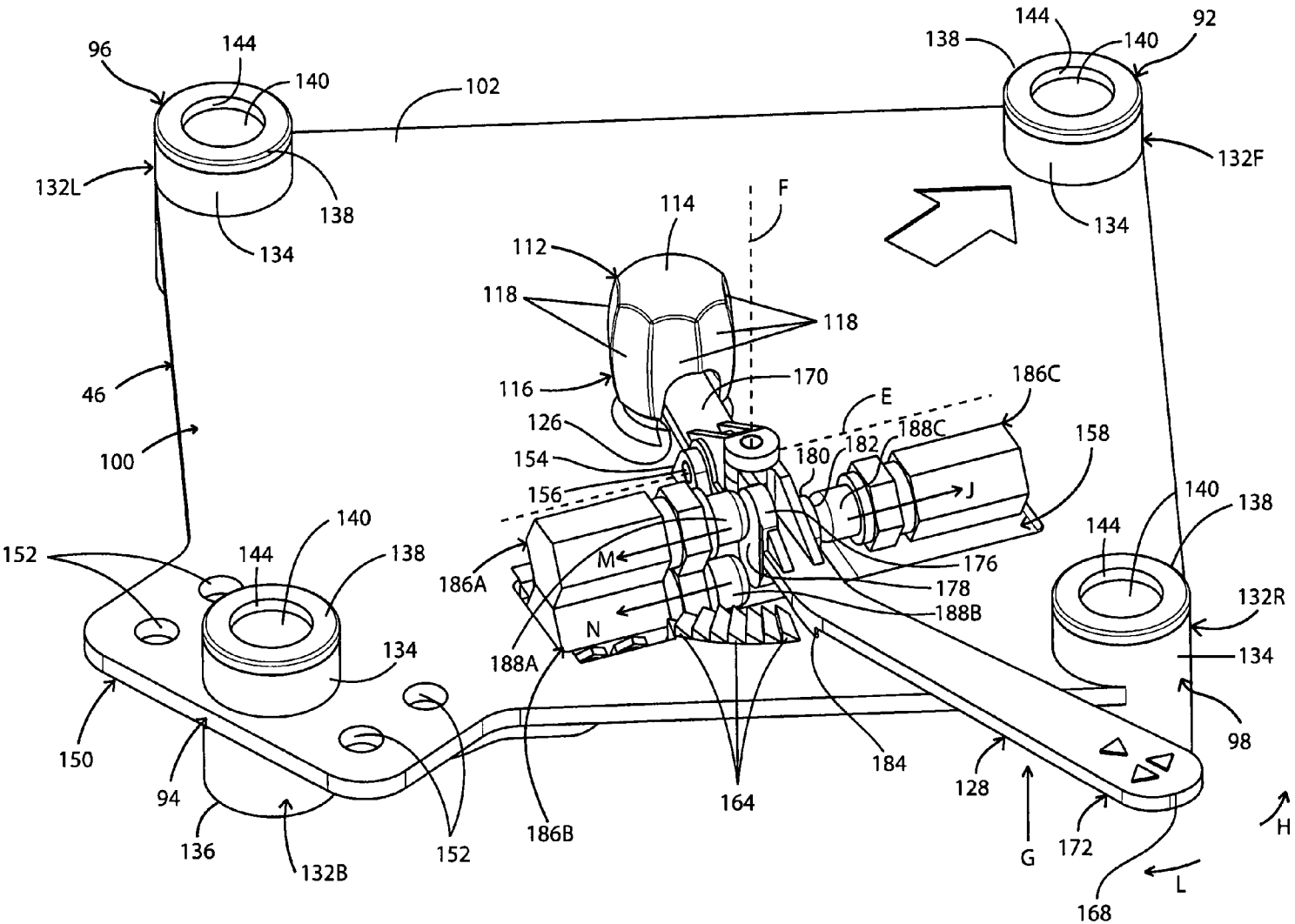
FIG. 6 is a top perspective view of the base of the tilt assembly.
Figure 7:
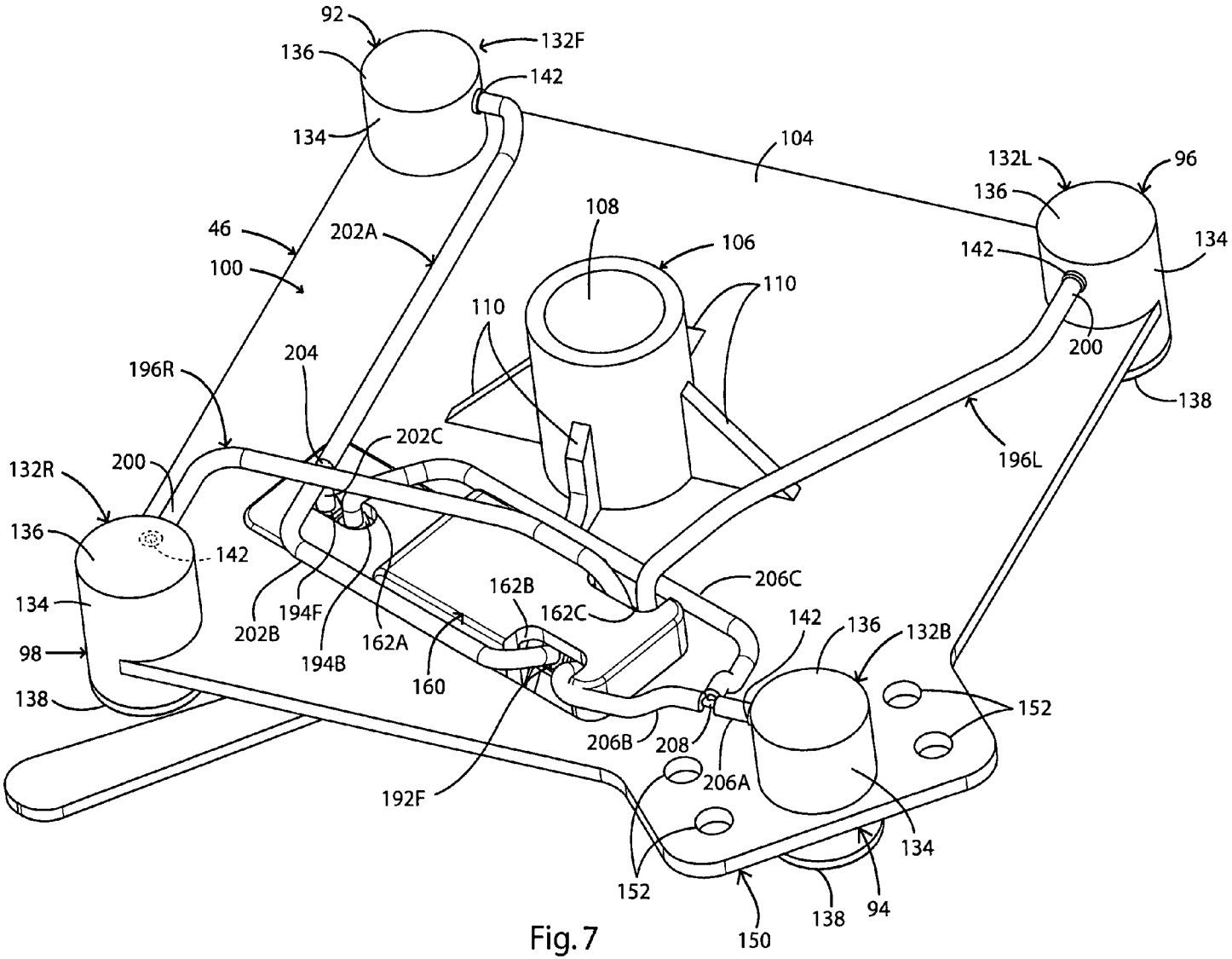
FIG. 7 is a bottom perspective view of the base of the tilt assembly.

With reference to FIGS. 6 and 7, plate 100 includes a backrest mounting location at a substantially rectangular flange 150 adjacent back 94 which extends outwardly on either side of cylinder 132B. A pair of mounting through holes 152 is formed through flange 150 from top 102 to bottom 104 of plate 100 on either side of cylinder 132B. Holes 152 are configured for receiving therethrough fasteners 44 (FIG. 1) in order to secure L-shaped connector 42 and backrest 18 on flange 150. Base 46 further includes a mounting area for mounting control lever 128 and the valves of the hydraulic system, which are described further below. A pair of horizontally spaced and generally triangular lever-mounting brackets 154 (only one shown in FIG. 6) are rigidly secured to and extend upwardly from top 102 of plate 100 adjacent entrance opening 126 of ball member 112. Through holes are formed in each mounting bracket 154 for receiving therein a pivot 156 whereby lever 128 is pivotally mounted on brackets 154 about a substantially horizontal axis E (FIG. 6). A recessed valve-mounting area 158 (FIG. 6) is formed in plate 100 extending downwardly from top 102 thereof. Area 158 is bounded along its bottom and sides by several valve-supporting walls 160 which are rigidly connected to and extend downwardly from bottom 104 of plate 100. Three through holes or access openings 162A-C are formed in walls 160 for receiving therethrough various hydraulic lines. A series of one-way ratchet teeth or locking teeth 164 are formed integrally with and extend upwardly from top 102 of plate 100 adjacent recessed area 158 on the opposite side of area 158 from ball member 112 and mounting flanges 154. Teeth 164 are disposed intermediate and generally midway between cylinders 132R and 132B.

Figure 8:
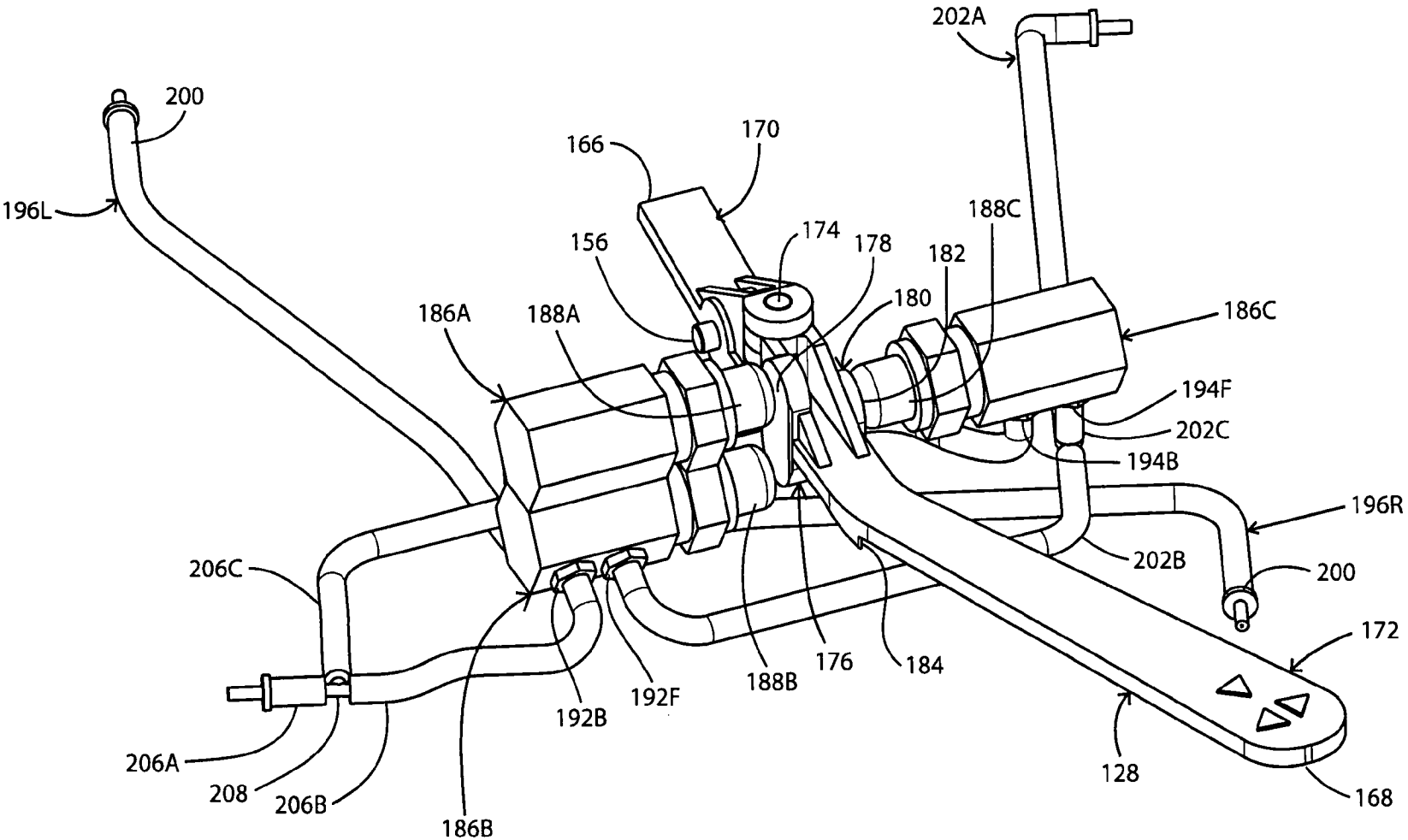
FIG. 8 is a top perspective view of the hydraulic valves, hydraulic lines and operating lever.
Figure 9:
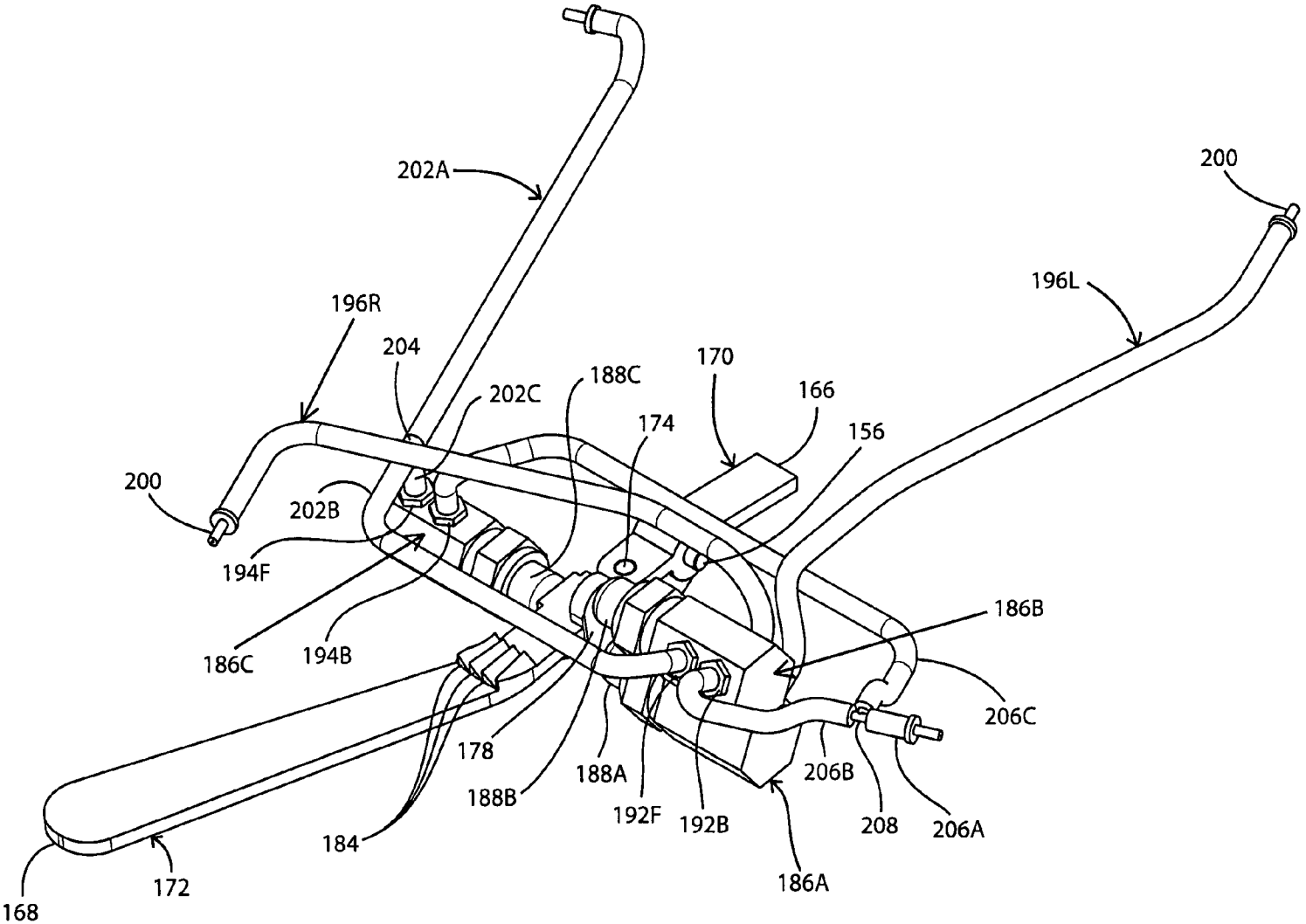
FIG. 9 is a bottom perspective view of the hydraulic valves, hydraulic lines and operating lever.

Referring now to FIGS. 7-10, control lever 128 and its associated structure, along with the remaining portions of the hydraulic system are now described in greater detail. Referring primarily to FIGS. 8 and 9, lever 128 has inner and outer terminal ends 166 and 168 and is formed of two pieces in the form of a shorter segment 170 and a longer segment 172 which are pivotally connected to one another about a pivot 174 whereby longer segment 172 is pivotable relative to segment 170 about an axis F (FIG. 6) which is substantially vertical and perpendicular to axis E. Pivot 174 extends through respective aligned holes formed in each of segments 170 and 172. As shown in FIGS. 8 and 9, pivots 156 are rigidly secured to and extend outwardly from either side of shorter segment 170. A dual-valve activator 176 is mounted on longer segment 172 adjacent its inner end and pivot 174 and includes a rearwardly facing flat vertical engaging surface 178. Likewise, a single-valve activator 180 is mounted on longer segment 172 just opposite activator 176 and includes a forward facing flat vertical engaging surface 182. Surfaces 178 and 182 are typically parallel to one another. A series of one-way ratchet teeth or locking teeth 184 is integrally formed with longer segment 172 and extend downwardly therefrom adjacent and radially outwardly of activators 176 and 180 relative to pivot 174. Teeth 184 are configured to releasably engage teeth 164 on plate 100 so that when teeth 184 and 164 are engaged, lever 128 is secured in a selected secured position and when they are disengaged or released from one another, lever 128 is movable to an unsecured position and in the exemplary embodiment is automatically returned to its home position shown in FIG. 6 as discussed further below.

Figure 10:
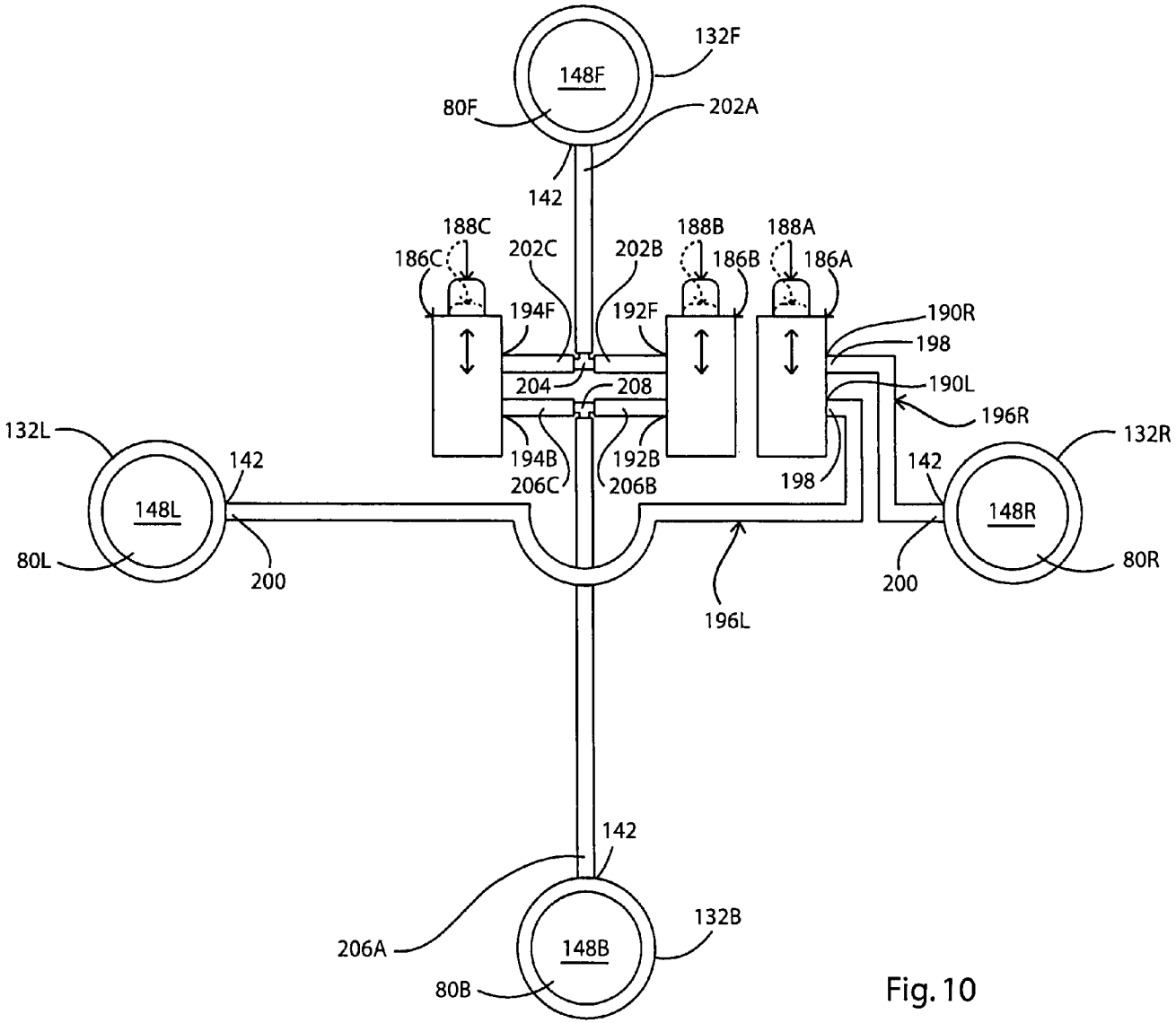
FIG. 10 is a diagrammatic view of the hydraulic systems of the tilt assembly.

With continued reference to FIGS. 6-10, the hydraulic system includes a left to right or side to side tilt control valve 186A, a first front to back tilt control valve 186B and a second front to back tilt control valve 186C. Each of valves 186 includes a housing defining an interior chamber for slidably receiving therein a depressible piston or plunger 188A-C along with an internal spring which biases the respective plunger outwardly to its closed position. Plungers 188A and 188B are configured to be depressed simultaneously by vertical engaging surface 178 of dual valve activator 176, while plunger 188C is configured to be depressed by vertical engaging surface 182 of activator 180. Side to side tilt valve 186A includes a pair of entry/exit ports 190L and 190R (FIG. 10) which are respectively associated with left and right actuators 148L and 148R. First front to back valve 186B likewise has a pair of entry/exit ports 192F and 192B respectively associated with actuators 148F and 148B. Likewise, second front to back valve 186C has a pair of entry/exit ports 194F and 194B respectively associated with front and back actuators 148F and 148B. A left hydraulic line 196L is connected at a first end 198 thereof to port 190L of the valve 186A and at a second opposed end 200 thereof to port 142 of left actuator 148L. Likewise, a right hydraulic line 196R is connected at a first end 198 thereof to port 190R of valve 186A and at an opposed end 200 thereof to right actuator 148R. Thus, the interior chambers 140 of left and right actuators 148L and 148R are in fluid communication with one another via lines 196L and 196R and valve 186A when plunger 188A is in an open or partially open position. FIG. 10 shows plunger 188A is slidably moveable as indicated by the double arrow between a closed position shown in solid lines and a fully open position shown in dashed lines. Plunger 188A increases the size of the passage through which hydraulic fluid may flow through valve 186A the more it is depressed into the housing of said valve. Left and right actuators 148L and 148R along with valve 186A and hydraulic lines 196L and 196R form one closed hydraulic system. Another separate closed hydraulic system is formed by front and back actuators 148F and 148B along with valve 186B and 186C and the associated interconnecting hydraulic lines. These hydraulic lines include three front hydraulic lines 202A-C which are interconnected at a T-connector 204 and extend respectively from connector 204 to the respective ports of front actuator 148F, front port 192F of valve 186B and front port 194F of valve 186C. Similarly, a rear set of hydraulic lines 206A-C are interconnected by another T-connector 208, from which said lines extend respectively to port 142 of back actuator 148B, back port 192B of valve 186B and back port 194B of valve 186C. Either one of valves 186B and 186C may be operated to allow hydraulic fluid to flow therethrough in order to provide for forward and backward tilting of seat support 48 or to prevent such tilting. Like valve 186A, each of valves 186B and 186C is a progressive valve configured to either cut off the flow of hydraulic fluid therethrough or to allow hydraulic fluid to flow with differing degrees of resistance depending on the degree to which plunger 188 is depressed to control the size of the passage through which the hydraulic fluid may flow through the respective valve.

Figure 11:
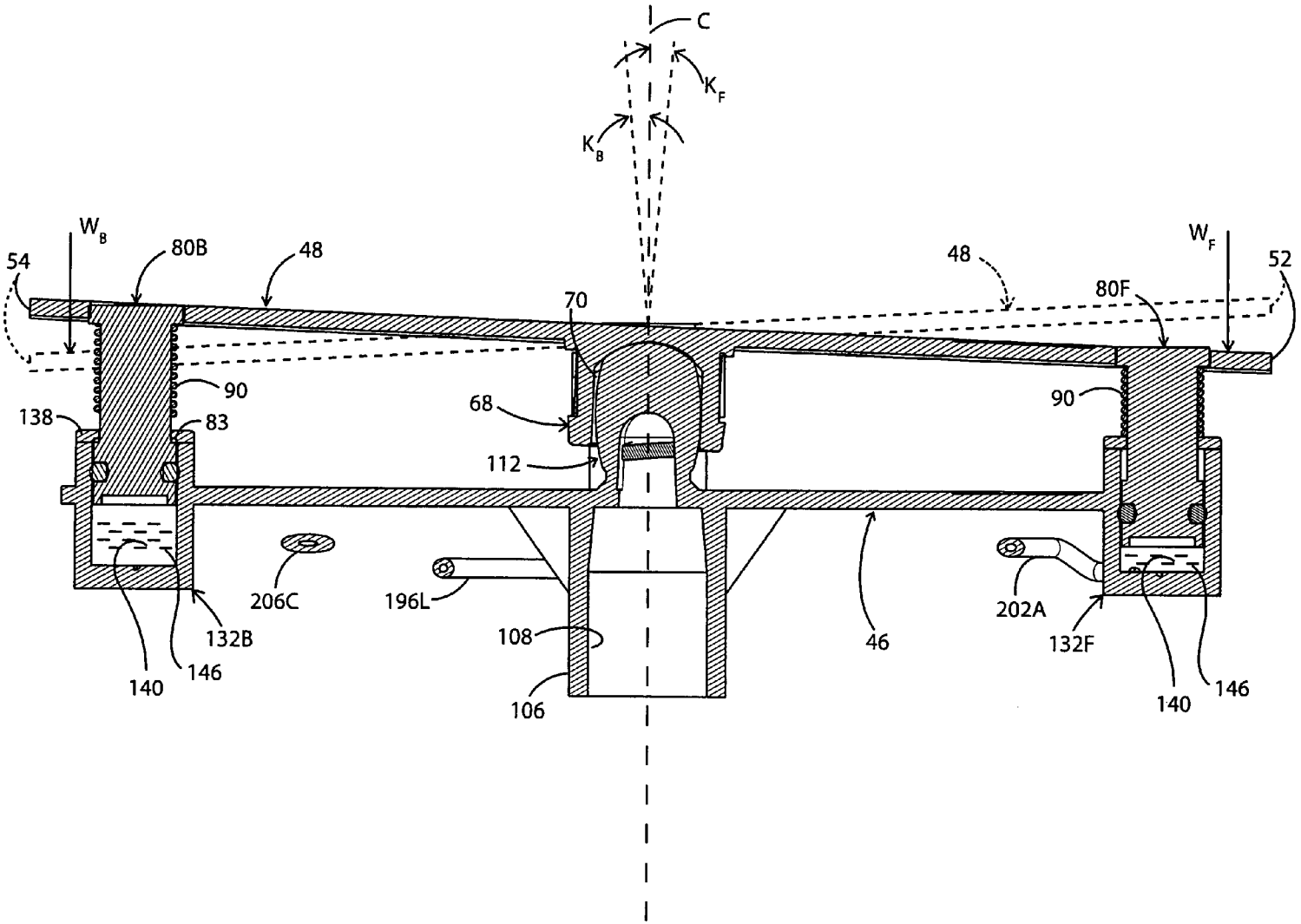
FIG. 11 is a sectional view similar to FIG. 4 showing the forward and backward tilting of the seat support of the tilt assembly.

The operation of tilt assembly 10 is now described. As shown in FIG. 6, outer end 168 of segment 172 of controller 128 may be pivoted upwardly (arrow G) so that segments 170 and 172 pivot as a unit about axis E and so that the terminal inner end 166 of shorter segment 170 pivots downwardly, which as previously indicated depresses button or pin 130 of the height adjustment mechanism as shown at arrow D in FIG. 4. This allows for the height adjustment previously described. In addition, outer end 168 of segment 162 may be pivoted in the forward direction (arrow H) about axis F relative to shorter segment 170 so that engaging surface 182 of activator 180 depresses plunger 188C (arrow J) of valve 186C to partially or fully open said valve. The opening of valve 186C allows the user to tilt seat support 48 along with seat 16 in the forward and backward directions only, as indicated in FIG. 11. More particularly, the user may shift his or her weight forward on seat 16 so that the downward force applied via seat 16 to seat support 48 forward of axis C is greater than the downward force applied rearward of axis C. This forward downward force or weight is indicated at $W_F$ in FIG. 11. The downward force or weight $W_F$ causes front piston 80F to move downwardly relative to front cylinder 132F so that the hydraulic fluid 146 within the interior chamber 140 of cylinder 132F is pressurized and forced into the interior chamber 140 of back cylinder 132B via the hydraulic pathway therebetween which includes line 202A, T-connector 204, line 202C, valve 186C, line 206C, T-connector 208 and line 206A. Depending on how far forward longer segment 172 of control lever 128 is moved forward and thus how far valve 186C is opened via the corresponding movement of plunger 188C, the resistance to the force or weight $W_F$ will be greater or lesser. As the back 54 of support 48 and back piston 80B move upwardly, ledge 83 may come into contact with the lower surface of annular top wall 138 to provide a stop to the tilting movement of support 48. If the user desires to tilt seat support 48 rearwardly as shown in dashed lines in FIG. 11, he or she simply shifts his or her weight rearwardly so that downward force behind axis C is greater than the downward force forward of axis C, the rearward downward force or weight being indicated at arrow $W_B$ in FIG. 11. The back 54 of seat support 48 thus tilts downwardly as the front 52 tilts upwardly in this scenario, with back piston 80B moving downwardly within interior chamber 140 of back cylinder 132B to force hydraulic fluid 146 along the same path but in the opposite direction.

The maximum angle or degree of tilting in the forward and the backward directions is indicated respectively at angles $K_F$ and $K_B$ in FIG. 11. Said angles are typically equal to one another and preferably at least 5 degrees and more typically 10 degrees. Although an angle of 10 degrees is likely sufficient to meet the needs of anyone sitting on seat 16 in a given position, angles K may be larger than this, for example up to 15 or 20 degrees especially where seat 16 is used for the purpose of exercising as discussed in greater detail further below. When the user is finished adjusting the forward or backward tilt of seat support 48, he or she may simply release lever 128 so that outer end 168 thereof is automatically moved back to its neutral position in response to the spring biased movement of plunger 188C in the direction opposite arrow J of FIG. 6 back to the closed position of valve 186C. When valve 186C is closed, hydraulic fluid may not flow therethrough and thus a hydraulic lock is provided which prevents the tilting movement of seat support 48 out of whatever position it is in when control lever 128 reaches its neutral or home position.

Figure 12:
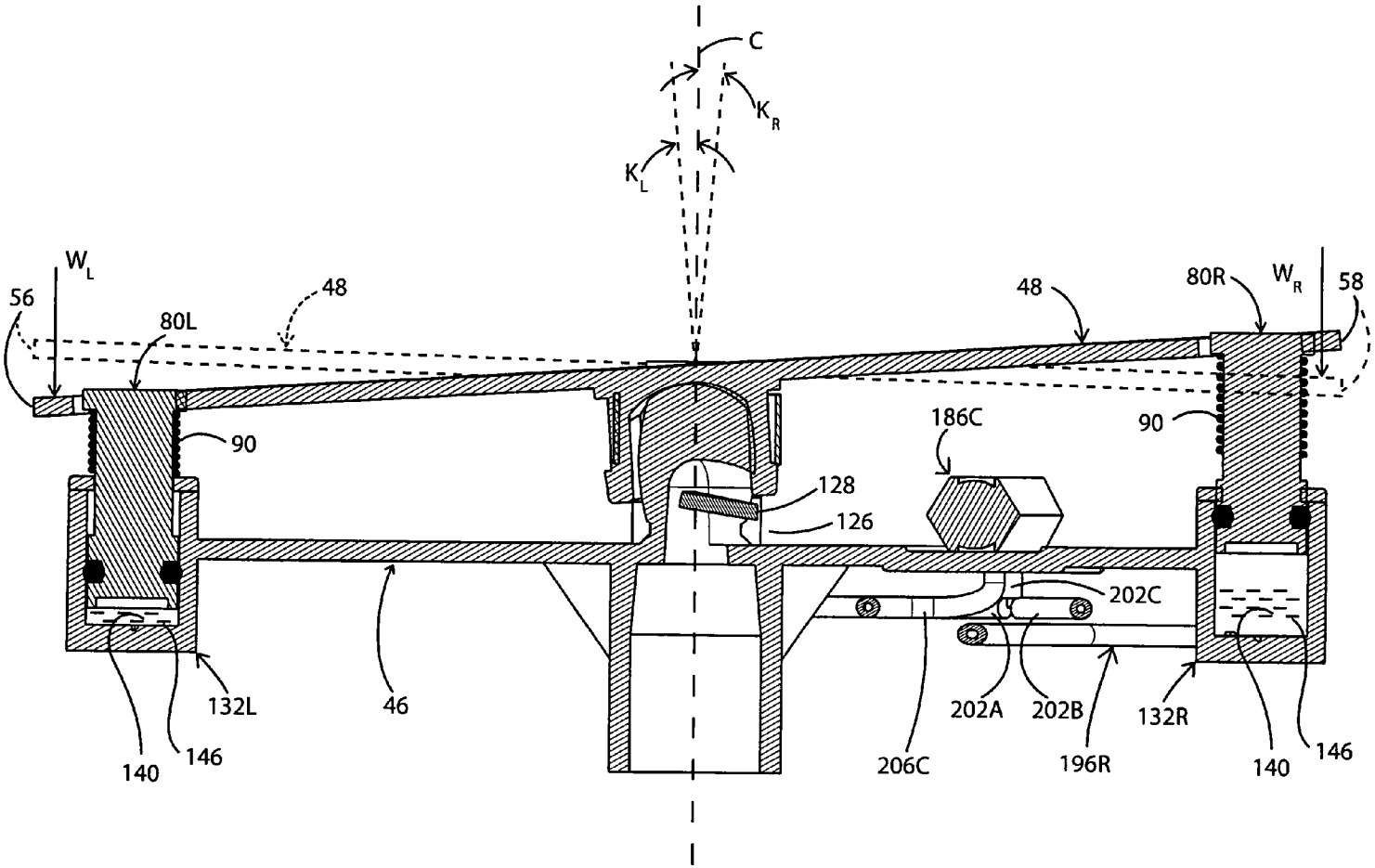
FIG. 12 is a sectional view similar to FIG. 5 showing the side to side tilting of the seat support of the tilt assembly.

The user may also pivot outer end 168 of segment 172 rearwardly (arrow L in FIG. 6) about axis F relative to shorter segment 170 so that engaging surface 178 of activator 176 engages and forces plungers 188A and 188B toward respective partial or fully opened positions, as indicated at arrows M and N in FIG. 6. The simultaneous opening of valves 186A and 186B allows for the forward and backward tilting of seat support 48 as well as its side to side tilting. The forward and backward tilting is achieved in the same manner as described with the use valve 186C except that hydraulic fluid 146 flows through an alternate path which includes line 202A, T-connector 204, line 202B, valve 186B, line 206B, T-connector 208 and line 206A. The side to side tilting of seat support 48 is illustrated in FIG. 12, with the tilting to the right shown in solid lines and the tilting to the left shown in dashed lines. Again, the user will shift his or her weight on seat 16 so that a greater downward force is applied to the right of axis C than is applied to the left of axis C, as represented by arrow $W_R$. Tilting support 48 to the left is likewise achieved by applying a greater downward force to the left of axis C than to the right of axis C, as illustrated by arrow $W_L$ in FIG. 12 so that left side 56 tilts downwardly as right side 58 tilts upwardly. As previously noted, the force for tilting seat support 48 is in the exemplary embodiment provided solely by the weight of the user on seat 16, and thus assembly is preferably free of a powered hydraulic pump for powering the flow of hydraulic fluid through its hydraulic systems. The respective angles or degrees of tilting to the right and left are respectively represented at angles $K_R$ and $K_L$ in FIG. 12 and fall within the same maximum ranges described above with reference to angles $K_F$ and $K_B$. It is noted that the use of the two valves 186A and 186B which may be in open positions at the same time via movement of lever segment 172 in one direction and the use of a third valve 186C which may alternately be in its open position via movement of segment 172 in the opposite direction provides an isolation mechanism which isolates the forward and backward tilting from the side to side tilting. More particularly, the tilting of seat support 48 is limited to forward and backward tilting when segment 172 is operated to open valve 186C when valves 186A and 186B are closed, while forward and backward tilting is alternately combined with side to side tilting to produce omni directional tilting when valves 186A and 186B are open and valve 186C is closed.

The simultaneous opening of valves 186A and 186B in conjunction with the ball and socket pivotal connection between base 46 and seat support 48 allows support 48 not only to tilt directly forward and backward and directly from side to side perpendicular thereto, but also to tilt in any direction relative to axis C. Thus, the user may rock, for instance, in a circular fashion, thereby shifting his or her weight along a generally circular pattern about axis C so that seat support 48 along with seat 16 may be tilted in any direction and continuously changed depending on where the greater amount of downward force is applied relative to axis C. The user may thus shift his or her weight to provide continuous shifting of the tilt angle and/or direction. In conjunction with the ability to control the degree of resistance provided by hydraulic fluid 146 depending on the extent to which valve 186A and 186B are open, the ability to tilt seat support 48 relative to base 46 especially in any direction provides a convenient way for the user to exercise in addition to the ability to set the angle of support 48 and seat 16 wherever desired. If the user wishes to lock the seat support 48 and seat 16 at a given degree of tilt, the user simply releases control lever 128 so that outer end 168 is automatically pivoted back to its home position in response to the spring biased movement of plungers 188A and 188B in the direction opposite arrows M and N in FIG. 6 to the closed position of valves 186A and 186B.

Figure 13:
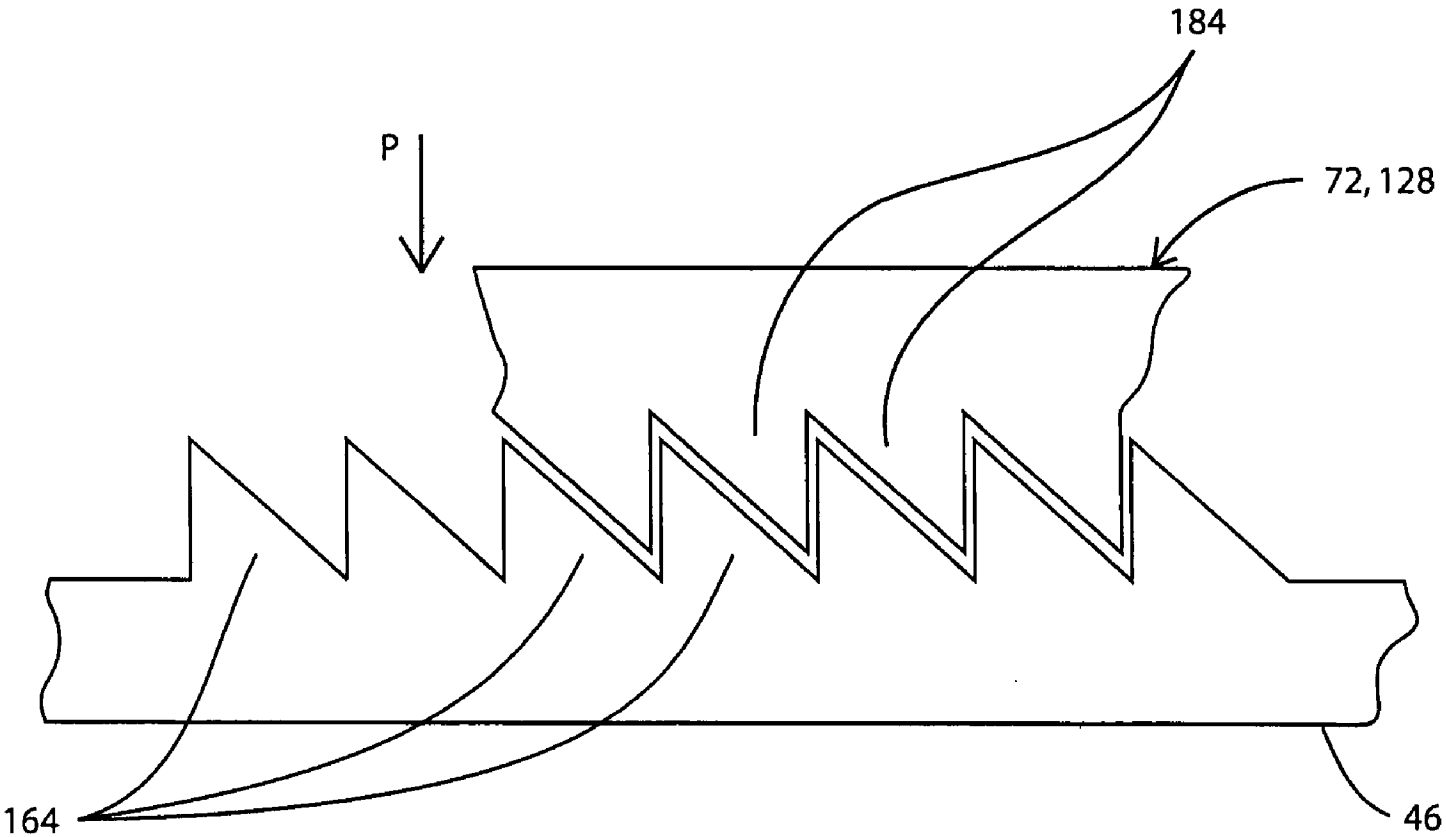
FIG. 13 is an enlarged side elevational view showing the teeth of the control lever engaging the teeth of the base to secure the control lever in a desired position.

As noted above, tilt assembly 10 offers the user the ability to exercise or at least continuously shift positions as desired when valves 186A and 18B are partially or fully open. In order to maintain said valves in an open position, longer segment 172 of control lever 128 is manipulated so that teeth 184 engage teeth 164, as shown in FIG. 13. To achieve the securing engagement between teeth 184 and 164, outer end 168 of segment 172 is moved rearwardly as indicated at arrow L in FIG. 6 and then moved downwardly as indicated at arrow T in FIG. 13. The engagement of teeth 184 and 164 thus prevents the forward pivoting movement of outer end 168, whereby valves 186A and 186B are maintained in a partially or fully open position. As will be evident, a given tooth 184 may engage any one of teeth 164 depending on the position of lever 128 in order to secure lever 128 and valves 186A and 186B in the various positions associated with varying degrees of resistance provided by the flow of hydraulic fluid 146 through said valves. The spring bias of plungers 188A and 188B to their forward closed positions applies a forward force on surface 178 which is translated to a forward force of teeth 184 on teeth 164, thus providing a frictional engagement between said teeth which holds longer segment 172 in this latching or securing engagement between teeth 184 and 164. To release the securing mechanism provided by the frictional latching engagement between teeth 184 and 164, the use simply pivots outer end 168 of longer segment 172 upwardly about axis E, after which the user may simply release manual engagement with segment 172, which automatically returns to its home position in response to the spring bias of plungers 188A and 188B. As previously noted, the movement of segment 172 to its home position thus produces a hydraulic lock in each of the hydraulic systems so that seat support 48 is secured at the position to which it had been tilted at the time valves 186A and 186B reach their closed positions.

Assembly 10 also provides an automatic leveling mechanism for leveling seat support 48 or returning it to its home or neutral position. More particularly, springs 90 are provided for this purpose. As shown in FIGS. 11 and 12, at least one of springs 90 is compressed between annular top walls 138 of the respective cylinder 132 and upper portions of the respective piston 80 or the bottom of plate 60 when the portion of seat support 48 adjacent the compressed spring is moved downwardly relative to the portion of base 46 therebelow. When control lever 128 is in its home position, seat support 48 will be hydraulically locked at a given position which may be a tilted position in which at least one of springs 90 is compressed. The automatic leveling of seat support 48 is achieved by moving outer end 168 of longer segment 172 rearwardly (arrow L in FIG. 6) while the user has removed his or her weight from atop seat 16. This movement of control lever 128 of course opens valves 186A and 186B to unlock the hydraulic lock whereby the compressed spring or springs 90 provides an upward force on the respective downwardly tilted portion of seat support 48 to raise the downwardly tilted portion back to its home position, thus providing the automatic leveling of seat support 48. Movement of outer end 168 forward (arrow H in FIG. 6) to depress plunger 188C may likewise lead to a leveling movement via a compressed spring 90 with respect to forward and backward tilting of support 48 without providing side to side leveling.

Tilt assembly 10 thus allows a seat such as seat 16 to be tilted in any direction relative to a chair base such as base 14 and relative to a backrest such as backrest 18. In addition, assembly 10 provides hydraulic systems which are capable of providing varying degrees of resistance to this tilting movement, which is useful both in providing exercise for the user as well as limiting the rate at which the tilting occurs for a given amount of weight applied at any given point on seat 16. The hydraulic systems further provide a hydraulic lock for securing the seat support and seat in any tilted position while also providing a simple mechanism for automatically leveling the seat support and seat.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a base;

a seat support which has a front, a back, and opposed sides, is adapted to mount on a bottom of a seat, and is disposed above and pivotally mounted on the base whereby the seat support is hydraulically tiltable relative to the base;

a manually actuated lever operatively connected to one of the seat support and base, and selectively movable to first, second, and third positions; and wherein the first position enables side to side tilting movement of the seat support relative to the base and disables frontward and backward tilting movement of the seat support relative to the base, the second position enables side to side and frontward and backward tilting movement of the seat support relative to the base; and the third position disables tilting movement of the seat support relative to the base.

2. The apparatus of claim 1 wherein the seat support is substantially non-rotatable about a vertical axis relative to the base.

3. The apparatus of claim 1 further comprising an isolation mechanism configured to isolate the frontward and backward tilting movement of the seat support from the side to side tilting movement of the seat support.

4. The apparatus of claim 1 further comprising a first hydraulic valve for controlling the side to side tilting movement of the seat support;

a second hydraulic valve for controlling the frontward and backward tilting movement of the seat support.

5. The apparatus of claim 1 further comprising a ball and socket pivotal connection between the base and seat support.

6. The apparatus of claim 1 further comprising a first hydraulic system operatively connected to the base and seat support for controlling the side to side tilting of the seat support.

7. The apparatus of claim 6 further comprising a second hydraulic system which is separate from the first hydraulic system and is operatively connected to the base and seat support for controlling the frontward and backward tilting of the seat support.

8. The apparatus of claim 6 wherein the apparatus is free of a powered hydraulic pump for powering hydraulic fluid flow through the first hydraulic system.

9. The apparatus of claim 6 further comprising a first hydraulic valve of the first system having a closed position, a fully open position and a plurality of partially open positions each providing a different size passage through which hydraulic fluid may flow; and a securing mechanism for selectively securing the valve at the partially open positions.

10. The apparatus of claim 1 further comprising first and second laterally spaced hydraulic actuators extending between the base and the seat support.

11. The apparatus of claim 10 wherein the first and second actuators are in fluid communication with one another.

12. The apparatus of claim 11 further comprising a hydraulic valve in fluid communication with each of the first and second actuators; an open position of the valve which provides fluid communication between the first and second actuators; and a closed position of the valve which closes fluid communication between the first and second actuators.

13. An apparatus comprising:

a base;

a seat support which has a front, a back, and opposed sides, is adapted to mount on a bottom of a seat, and is disposed above and pivotally mounted on the base whereby the seat support is tiltable from side to side relative to the base;

a ball and socket pivotal connection between the base and seat support;

a collar defining the socket;

a non-circular inner perimeter on the collar which bounds the socket; and a non-circular outer perimeter on the ball which engages the non-circular inner perimeter to prevent rotational movement of the seat support about a vertical axis relative to the base.

14. An apparatus comprising:

a base;

a seat support which has a front, a back, and opposed sides, is adapted to mount on a bottom of a seat, and is disposed above and pivotally mounted on the base whereby the seat support is tiltable from side to side relative to the base;

a ball and socket pivotal connection between the base and seat support;

a pin-receiving cavity formed in the ball having a downwardly opening first entrance opening adapted to receive there through an activator pin of a gas spring.

15. An apparatus comprising:

a base;

a seat support which has a front, a back, and opposed sided, is adapted to mount on a bottom of a seat, and is disposed above and pivotally mounted on the base whereby the seat support is tiltable from side to side relative to the base; and a first hydraulic value for controlling tilting movement of the seat support relative to the base;

a lever movable in a first direction to operate the first valve and in a second direction different from the first direction to operate the second valve; and a lever securing mechanism having a secured position for securing the lever and an unsecured position; and wherein the lever is movable in a third direction different from the first and second directions form the unsecured position to the secured position.

16. The apparatus of claim 15 wherein the lever is movable in a fourth direction which is different from the first, second and third directions and is adapted to operate a height adjustment mechanism configured for adjusting the height of the base.

17. An apparatus comprising:

a base;

a seat support which has a front, a back, and opposed sides, is adapted to mount on a bottom of a seat, and is disposed above and pivotally mounted on the base whereby the seat support is tiltable from side to side relative to the base;

a ball and socket pivotal connection between the base and seat support;

a first hydraulic system operatively connected to the base and seat support for controlling the side to side tilting of the seat support; and a control lever operatively connected to the first hydraulic system;

a first segment on the lever;

a second segment on the lever; and a pivotal connection between the first and second segments whereby the second segment is pivotable relative to the first segment about a first axis.

* * * * *

UNITED STATES PATENT AND TRADEMARK OFFICE

CERTIFICATE OF CORRECTION

PATENT NO. : 7,922,247 B2
APPLICATION NO. : 12/148425
DATED : April 12, 2011
INVENTOR(S) : Robert G. Dickie It is certified that error appears in the above-identified patent and that said Letters Patent is hereby corrected as shown below:

Column 12, line 19 (Claim 15) change the phrase "and opposed sided" to --and opposed sides--

Column 12, line 24 (Claim 15) change the phrase "a first hydraulic value" to --a first hydraulic valve--

Column 12, line 26 (Claim 15) insert --a second hydraulic valve for controlling tilting movement of the seat support relative to the base--

Column 12, line 32 (Claim 15) change the phrase "form the unsecured" to --from the unsecured--

Signed and Sealed this
Twenty-first Day of June, 2011

David J. Kappos

David J. Kappos
*Director of the United States Patent and Trademark Office*